US011028795B2

(12) United States Patent
Stutika et al.

(10) Patent No.: US 11,028,795 B2
(45) **Date of Patent: *Jun. 8, 2021**

(54) OPERATION OF A FUEL INJECTOR HAVING A HYDRAULIC STOP

(71) Applicant: CPT Group GmbH, Hannover (DE)

(72) Inventors: Markus Stutika, Regensburg (DE); Gerd Rösel, Regensburg (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/339,231

(22) PCT Filed: Sep. 28, 2017

(86) PCT No.: PCT/EP2017/074681
§ 371 (c)(1),
(2) Date: Apr. 3, 2019

(87) PCT Pub. No.: WO2018/069058
PCT Pub. Date: Apr. 19, 2018

(65) Prior Publication Data

US 2019/0234335 A1 Aug. 1, 2019

(30) Foreign Application Priority Data

Oct. 12, 2016 (DE) ..... 10 2016 219 891.2

(51) Int. Cl.
*F02D 41/20* (2006.01)
*F02M 45/12* (2006.01)
(Continued)

(52) U.S. Cl.
CPC ..... *F02D 41/20* (2013.01); *F02M 45/12* (2013.01); *F02D 41/221* (2013.01);
(Continued)

(58) Field of Classification Search
CPC ..... F02D 2041/2003; F02D 2041/2055; F02D 41/20; F02D 45/12
See application file for complete search history.

(56) References Cited

U.S. PATENT DOCUMENTS 6,513,371 B1 2/2003 Jett et al. ..... 73/114.42
9,201,427 B2 12/2015 Kraft et al.
(Continued)

FOREIGN PATENT DOCUMENTS

DE 10 2008 017 163 B3 11/2009 ..... F02D 41/00
DE 10 2009 009 796 B3 10/2010 ..... F02D 41/22
(Continued)

OTHER PUBLICATIONS

German Office Action, Application No. 10 2016 219 891.2, 5 pages, dated Jun. 6, 2017.
(Continued)

*Primary Examiner* — Gonzalo Laguarda
(74) *Attorney, Agent, or Firm* — Slayden Grubert Beard PLLC

(57) ABSTRACT

Various embodiments include a method for operating a fuel injector comprising: applying a first current to a solenoid to perform a first injection process and inject a predefined injection quantity; determining a value of a system parameter indicating the relationship between the actual fuel quantity and the predefined quantity; determining, on the basis of the value of the system parameter, whether the actually injected fuel quantity is smaller than the predefined fuel quantity by a predefined amount corresponding to a disparity between a magnetic force exerted on the armature in the direction of the pole piece and an opposite hydraulic force exerted on the armature by fuel; and if it was determined that the quantities differ by enough, applying a second current to the solenoid to perform a second injection;
(Continued)

wherein the second current exerts a lower magnetic force on the armature in the direction of the pole piece.

9 Claims, 3 Drawing Sheets

(51) Int. Cl.
*F02M 45/02* (2006.01)
*F02D 41/24* (2006.01)
*F02D 41/22* (2006.01)

(52) U.S. Cl.
CPC .... *F02D 41/247* (2013.01); *F02D 2041/2003* (2013.01); *F02D 2041/2048* (2013.01); *F02D 2041/2055* (2013.01); *F02D 2200/0602* (2013.01); *F02D 2200/063* (2013.01); *F02D 2200/0616* (2013.01); *F02M 45/02* (2013.01)

(56) References Cited

U.S. PATENT DOCUMENTS

| | | | | |
|---|---|---|---|---|
| 9,228,520 | B2 | 1/2016 | Joos et al. | |
| 10,072,596 | B2 * | 9/2018 | Dames | F02M 51/061 |
| 10,247,125 | B2 * | 4/2019 | Aono | F02D 41/20 |
| 10,648,420 | B2 * | 5/2020 | Stutika | F02D 41/2467 |
| 2001/0035465 | A1 * | 11/2001 | Shinogle | F02M 63/0026 239/96 |
| 2013/0074806 | A1 | 3/2013 | Casalone et al. | 123/456 |
| 2013/0116912 | A1 | 5/2013 | Altenschmidt | 701/103 |
| 2018/0156153 | A1 | 6/2018 | Denk | |
| 2018/0266353 | A1 | 9/2018 | Shirasaki et al. | |

FOREIGN PATENT DOCUMENTS

| | | | | |
|---|---|---|---|---|
| DE | 10 2010 027 267 | A1 | 4/2011 | F02D 41/00 |
| DE | 10 2015 111 086 | A1 | 2/2016 | F02D 41/20 |
| DE | 10 2014 017 987 | A1 | 6/2016 | F02D 41/22 |
| DE | 10 2015 210 794 | B3 | 7/2016 | F02D 41/20 |
| JP | 2018155179 | A | 10/1918 | |
| KR | 20120093205 | A | 8/2012 | |
| KR | 20130042491 | A | 4/2013 | |
| KR | 20140027384 | A | 3/2014 | |
| WO | 2018/069058 | A1 | 4/2018 | F02D 41/20 |

OTHER PUBLICATIONS

International Search Report and Written Opinion, Application No. PCT/EP2017/074681, 20 pages, dated Jan. 17, 2018.
Korean Notice of Allowance, Application No. 2020049932476, 3 pages, dated Jul. 22, 2020.

* cited by examiner

OPERATION OF A FUEL INJECTOR HAVING A HYDRAULIC STOP

CROSS-REFERENCE TO RELATED APPLICATIONS

This application is a U.S. National Stage Application of International Application No. PCT/EP2017/074681 filed Sep. 28, 2017, which designates the United States of America, and claims priority to DE Application No. 10 2016 219 891.2 filed Oct. 12, 2016, the contents of which are hereby incorporated by reference in their entirety.

TECHNICAL FIELD

The present disclosure relates to fuel injectors. Various embodiments include methods and/or systems for operating fuel injectors having a hydraulic stop.

BACKGROUND

In the case of fuel injectors having a so-called hydraulic stop, no direct contact between the armature and the pole piece arises when the fuel injector opens, since the fuel flows between the armature and the pole piece, and in so doing exerts a hydraulic force on the armature countering the magnetic force. Said two forces cancel each other out in the open state of the fuel injector, so that a gap of substantially constant width is present between the armature and the pole piece. However, if the hydraulic force is too low, for example in the case of a defective fuel pump (high-pressure pump), the necessary gap width cannot be maintained and the injection of fuel is blocked after a very short time because of the correspondingly large pressure drop in the small gap (or in the closed gap, in a worst-case scenario).

SUMMARY

The teachings of the present disclosure describe methods and systems for operating a fuel injector having a hydraulic stop such that the above problems in the case of a reduced fuel pressure can be avoided or countered. For example, some embodiments include a method for operating a fuel injector (1) having a hydraulic stop, wherein the fuel injector (1) has a solenoid drive and a pole piece (6), wherein the solenoid drive has a movable armature (4) and a nozzle needle (5) which can be moved by the armature (4), the method comprising the steps of: applying (510) a first current profile to the solenoid drive of the fuel injector (1) in order to perform a first injection process and to thereby inject a predefined injection quantity, determining (520) a first value of a system parameter that is indicative of a relationship between the actually injected fuel quantity and the predefined fuel quantity, determining (530), on the basis of the determined first value of the system parameter, whether the actually injected fuel quantity is so much smaller than the predefined fuel quantity that this could be caused by a disparity between a magnetic force exerted on the armature (4) in the direction of the pole piece (6) and an opposite hydraulic force exerted on the armature (4) by fuel, and if it was determined that there could be a disparity between the magnetic force and the hydraulic force, applying (535) a second current profile to the solenoid drive of the fuel injector (1) in order to perform a second injection process, wherein the second current profile is designed such that, in comparison with the first current profile, a lower magnetic force is exerted on the armature (4) in the direction of the pole piece (6).

In some embodiments, the system parameter relates to a cylinder-specific smooth running, a cylinder-specific lambda measurement, or a cylinder-specific misfire detection.

In some embodiments, the first current profile has a first peak current value, and the second current profile has a second peak current value, and wherein the second peak current value is smaller than the first peak current value.

In some embodiments, the first current profile has a first holding current value, and the second current profile has a second holding current value, and wherein the second holding current value is smaller than the first holding current value.

In some embodiments, the first current profile is applied by means of at least one first voltage pulse, and the second current profile is applied by means of at least one second voltage pulse, and wherein the second voltage pulse has a lower voltage than the first voltage pulse.

In some embodiments, the method also comprises: determining (520) a second value of the system parameter, determining (530), on the basis of the determined second value of the system parameter, whether the actually injected fuel quantity is so much smaller than the predefined fuel quantity that this could be caused by a disparity between a magnetic force exerted on the armature (4) in the direction of the pole piece (6) and an opposite hydraulic force exerted on the armature (4) by fuel, and if it was determined that there could be a disparity between the magnetic force and the hydraulic force, applying (535) a third current profile to the solenoid drive of the fuel injector in order to perform a third injection process, wherein the third current profile, in comparison with the second current profile, is designed such that a lower magnetic force is exerted on the armature (4) in the direction of the pole piece (6).

In some embodiments, the determination of whether the actually injected fuel quantity is so much smaller than the predefined fuel quantity that a disparity could exist between the magnetic force and the hydraulic force, comprises comparison of the determined value of the system parameter with a reference value.

As another example, some embodiments include an engine control unit for a vehicle, which is designed to use a method as described above.

As another example, some embodiments include a computer program which, when executed by a processor, is designed to carry out the method as described above.

BRIEF DESCRIPTION OF THE DRAWINGS

Further advantages and features of the present teachings are included in the description hereunder of an example embodiment. In the figures.

DETAILED DESCRIPTION

Figure 1:
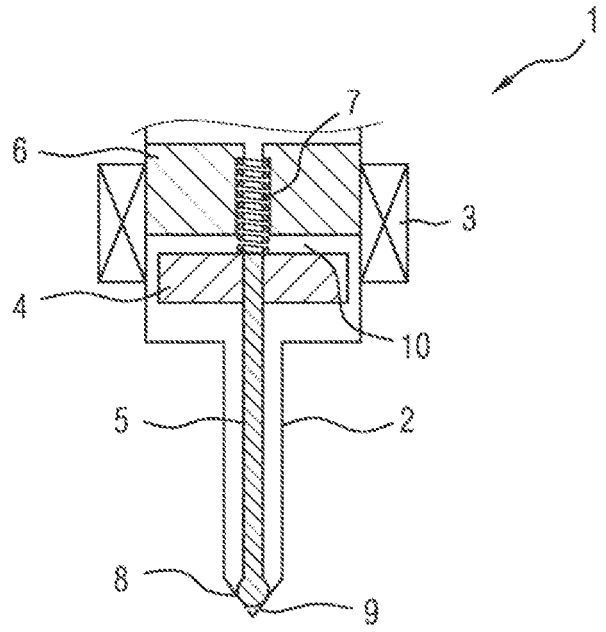
FIG. 1 shows a fuel injector having a hydraulic stop in a closed state.

Some embodiments include a method for the operation of a fuel injector having a hydraulic stop, wherein the fuel injector has a solenoid drive and a pole piece, wherein the solenoid drive has a movable armature and a nozzle needle which can be moved by the armature. In some embodiments, the method comprises the following: (a) applying a first current profile to the solenoid drive of the fuel injector in order to perform a first injection operation and to thereby inject a predefined injection quantity, (b) determining a first value of a system parameter that is indicative of a relationship between the actually injected fuel quantity and the predefined fuel quantity, (c) determining, on the basis of the determined first value of the system parameter, whether the actually injected fuel quantity is so much smaller than the predefined fuel quantity that this could be caused by a disparity between a magnetic force exerted on the armature in the direction of the pole piece and an opposite hydraulic force exerted on the armature by fuel, and (d) if it was determined that there could be a disparity between the magnetic force and the hydraulic force, applying a second current profile to the solenoid drive of the fuel injector in order to perform a second injection process, wherein the second current profile is designed such that, in comparison with the first current profile, a lower magnetic force is exerted on the armature in the direction of the pole piece (so that a greater gap is created between the pole piece and the armature).

In some embodiments, a value of a system parameter can be used to determine whether a fuel quantity actually injected during a first injection process, which is performed by applying a first current profile to the solenoid drive, is so much smaller than a predefined fuel quantity (nominal fuel quantity) that this could be caused by a disparity between a magnetic force exerted on the armature in the direction of the pole piece and an opposing hydraulic force exerted on the armature by fuel. Such a disparity leads to the gap between the armature and pole piece being so small (or non-existent) that very little (or no) fuel is injected, i.e. the fuel injector cannot function normally. This may in some cases be eliminated (at least partially) by applying a second current profile to the solenoid drive, if the second current profile is designed such that the magnetic force acting on the armature in the direction of the pole piece is lower than during the first injection process. Because of the lower magnetic force, a larger gap exists between the armature and the pole piece when the magnetic force is balanced by the opposing hydraulic force, which leads to a larger volumetric flow of fuel.

In this document, a "fuel injector having a hydraulic stop" refers to a fuel injector in which the fuel flows through a gap between the armature and the pole piece. The "hydraulic stop" is produced by this volumetric flow and decelerates the armature movement in the direction of the pole piece towards the end of an opening procedure.

In this document, "current profile" refers to a predetermined time profile (for example set by closed-loop control) of the intensity of the current running through the magnet coil of the solenoid drive during an actuation process.

In some embodiments, the method begins with an injection process in which the solenoid drive is loaded with a first current profile which is designed to achieve an injection of a predetermined injection quantity on the assumption of a specific fuel pressure (for example a fuel pressure that is normal for operation, or that is already reduced in response to the detection of a fault). In other words, the first current profile is provided for the expected (for example, normal) operation (for example, without a reduced fuel pressure). In connection with this actuation, a first value of the system parameter is then determined and based on this first value it is determined whether the actually injected fuel quantity is so much smaller than the predefined fuel quantity that a disparity could exist between the magnetic force and the hydraulic force. This would be the case if the fuel pressure is reduced, for example because of a defective high-pressure pump, i.e. is substantially lower than the usual (or expected) fuel pressure.

If it is determined that a disparity could exist between the magnetic force and the hydraulic force, the solenoid drive is then loaded with a second current profile which differs from the first current profile in that a smaller magnetic force is now exerted on the armature in the direction of the pole piece. Because of the smaller magnetic force, the equilibrium between the magnetic force and the hydraulic force is created at a larger gap between the armature and the pole piece than when actuated by way of the first current profile. A larger volumetric flow can thus flow through the gap and ultimately a larger actually injected fuel quantity can be achieved, which quantity is the same as or closer to the predefined fuel quantity. In other words, correct functioning of the fuel injector can be achieved. Precise closed-loop control of the injected fuel quantity can however be performed by other methods known per se.

In some embodiments, the system parameter relates to a cylinder-specific smooth running, a cylinder-specific lambda measurement, or a cylinder-specific misfire detection. Deviations in the cylinder-specific smooth running or the cylinder-specific lambda measurement from the corresponding reference values, occurring in normal operation, indicate an actual injection quantity which is defective or incorrect in comparison with the predetermined injection quantity. Also, if a misfire is detected, this indicates a substantially different actual injection quantity.

In some embodiments, the first current profile has a first peak current value, and the second current profile has a second peak current value, wherein the second peak current value is smaller than the first peak current value. In this document, "peak current value" refers to the value of the current intensity at which a voltage pulse is terminated at the beginning of an actuating procedure. At a smaller peak current value in the second current profile, the maximal magnetic force on the armature in the direction of the pole piece is thus also smaller than when the first current profile is used.

In some embodiments, the first current profile has a first holding current value, and the second current profile has a second holding current value, wherein the second holding current value is smaller than the first holding current value. In this document, "holding current value" refers to the value of the current intensity which is set for keeping the opened fuel injector open during the injection. At a smaller holding current value in the second current profile, the maximal magnetic force on the armature in the direction of the pole piece is thus also smaller than when the first current profile is used.

In some embodiments, the first current profile is applied by means of at least one first voltage pulse, and the second current profile is applied by means of at least one second voltage pulse, wherein the second voltage pulse has a lower voltage than the first voltage pulse. By the use of a lower voltage for the generation of the second current profile, the current intensity (and thus the magnetic force) increases less rapidly than in conjunction with the first current profile.

In some embodiments, the method also comprises the following: (a) determining a second value of a system parameter, (b) determining, on the basis of the determined second value of the system parameter, whether the actually injected fuel quantity is so much smaller than the predefined fuel quantity that this could be caused by a disparity between the magnetic force exerted on the armature in the direction of the pole piece and the opposite hydraulic force exerted on the armature by fuel, and (c) if it was determined that there could be a disparity between the magnetic force and the hydraulic force, applying a third current profile to the solenoid drive of the fuel injector in order to perform a third injection process, wherein the third current profile is designed such that, in comparison with the second current profile, a lower magnetic force is exerted on the armature in the direction of the pole piece.

In some embodiments, a second value of the system parameter is determined (corresponding to actuation with the second current profile), and based on this second value, it is determined whether the actually injected fuel quantity (on actuation with the second current profile) is so much smaller than the predefined fuel quantity that this could be caused by a disparity between the magnetic force exerted on the armature in the direction of the pole piece and the opposite hydraulic force exerted on the armature by fuel. In other words, it is checked whether the second current profile leads to a correct injection in the sense that the fuel injector is functioning correctly. If this is not the case, the solenoid drive is then loaded with a third current profile which differs from the second current profile in that a lower magnetic force is now exerted on the armature in the direction of the pole piece. By virtue of the lower magnetic force, the equilibrium between the magnetic force and the hydraulic force is created at a larger gap between the armature and the pole piece than when actuated by way of the second (and first) current profile. An (even) larger volumetric flow can thus flow through the gap and ultimately a larger actually injected fuel quantity can be achieved, which is closer to the predefined fuel quantity.

The method steps may in particular cases be repeated until it is no longer determined that a disparity could exist between the magnetic force and the hydraulic force, i.e. until a correct function of the fuel injector is ensured. Here it must be ensured, for example by observing a threshold value, that a choking in the needle stroke (at the top in the gap and at the bottom at the end of the needle) is prevented. As stated above, the injected fuel quantity must be adjusted again in some cases (for example by a closed-loop control process known in itself) after a correct function of the fuel injector has been ensured.

In some embodiments, the determination of whether the actually injected fuel quantity is so much smaller than the predefined fuel quantity that a disparity could exist between the magnetic force and the hydraulic force, comprises comparison of the determined value of the system parameter with a reference value. In other words, the determined (first and/or second) value of the system parameter is compared with a reference value. If the determined value deviates from the reference value, or if the difference between the determined value and the reference value exceeds a predefined threshold value, it is determined that a disparity could exist between the magnetic force and the hydraulic force.

In some embodiments, there is an engine control unit for a vehicle, which engine control unit is designed to use a method according to the first aspect and/or one of the above exemplary embodiments. This engine control unit enables, in a simple manner, in particular by modifying a current profile as a function of a value of a system parameter, that a malfunction of a fuel injector having a hydraulic stop, caused by a reduced fuel pressure, can be countered and eliminated.

In some embodiments, there is a computer program which, when it is executed by a processor, is designed to carry out the method according to the first aspect and/or one of the above exemplary embodiments. Within the meaning of this document, the designation of a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the methods described above.

The computer program can be implemented as a computer-readable instruction code in any suitable programming language, such as in JAVA, C++ etc. for example. The computer program can be stored on a computer-readable storage medium (CD-ROM, DVD, Blu-ray disk, removable drive, volatile or non-volatile memory, integral memory/processor etc.). The instruction code can program a computer or other programmable devices, such as in particular a control unit for an engine of a motor vehicle, in such a way that the desired functions are executed. Furthermore, the computer program may be provided in a network such as, for example, the Internet, from which a user can download it as required.

The methods can be implemented both by means of a computer program, i.e. software, and also by means of one or more specific electrical circuits, i.e. as hardware or in any desired hybrid form, i.e. by means of software components and hardware components. It should be noted that embodiments of the teachings herein have been described with reference to different subjects. In particular, some embodiments are described by way of method and other embodiments are described by way of device. However, it will become immediately clear to a person skilled in the art on reading this application that, unless explicitly stated otherwise, in addition to a combination of features which are associated with one type of subject matter, any combination of features which are associated with different types of subjects is also possible. It should be noted that the embodiments described below are merely a limited selection of possible variant embodiments of the teachings herein.

FIG. 1 shows a fuel injector 1 having a hydraulic stop in a closed state. The fuel injector 1 has a housing 2, a coil 3, a movable armature 4, a nozzle needle 5 which is or can be mechanically coupled (for example via a driver) to the armature, a pole piece 6, and a calibration spring 7. In the state depicted in FIG. 1, the valve needle rests in the valve seat 8 and therefore blocks the injection bores 9. In this state, the gap 10 between the armature 4 and the pole piece consequently has a maximal width.

Figure 2:
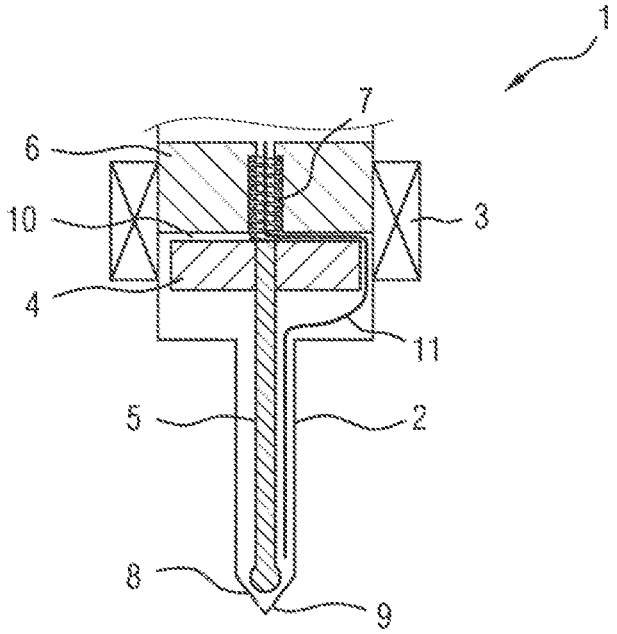
FIG. 2 shows the fuel injector shown in FIG. 1 in an open state.

When a voltage is applied to the coil 3, the armature 4 is moved in the direction of the pole piece 6 by electromagnetic forces. Owing to mechanical coupling, the nozzle needle 5 likewise moves and releases the injection bores 9 for the supply of fuel. In the case of fuel injectors with an idle stroke, the mechanical coupling between the armature 4 and the nozzle needle 5 only takes place when the armature 4 has overcome the idle stroke. In the case of fuel injectors without an idle stroke, the needle movement begins at the same time as the armature movement. This state is shown in FIG. 2. As can be derived from FIG. 2, the gap 10 between the armature 4 and the pole piece 6 is now considerably smaller than in FIG. 1, and the nozzle needle 5 is accordingly positioned at a distance from the valve seat 8. There is now a path for the fuel flow 11 within the fuel injector 1. The volumetric flow 11 has to flow through the gap 10 between the armature and the pole piece 6, and laterally bypass the armature 4 to reach the injection bores 9.

This results in a drop in pressure across the armature 4, which generates a (hydraulic) force countering the magnetic force. The smaller the gap 10, the greater the drop in pressure and therefore the higher the force in the closing direction. The armature 4 therefore moves in the direction of the pole piece 6 until the force caused by the pressure drop is at equilibrium with the magnetic force. If this is the case, the upper stop is reached. However, there is no contact between the armature 4 and the pole piece 6, but rather the hydraulic stop is produced by the volumetric flow 11.

Figure 3:
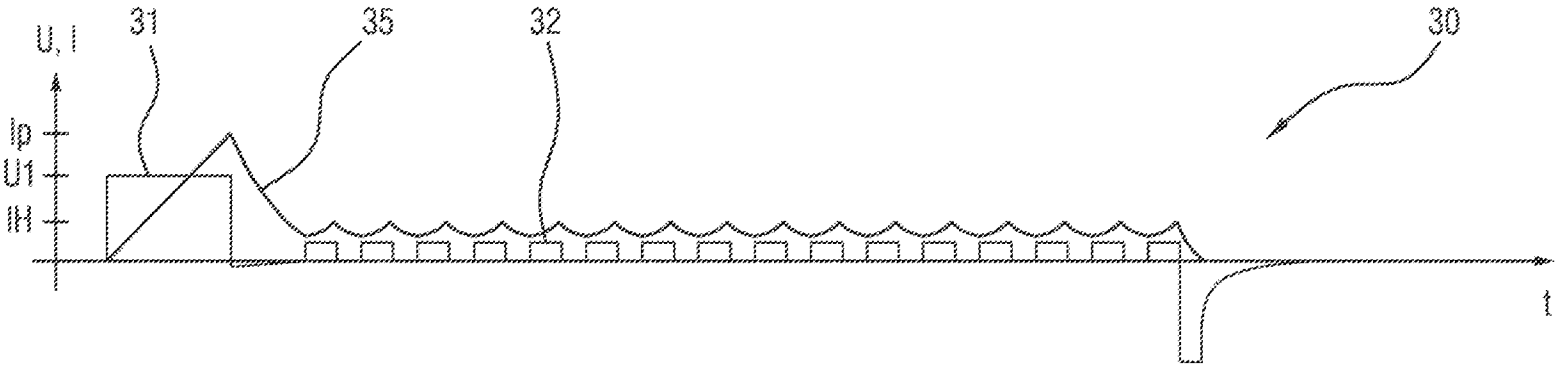
FIG. 3 shows temporal profiles of the voltage and current intensity in a conventional operation of a fuel injector having a hydraulic stop.

The diagram 30 in FIG. 3 shows temporal profiles of voltage (U) 31, 32 and current intensity (I) 35 in the case of conventional operation of the fuel injector 1. Actuation begins with a boost phase in which a voltage pulse 31 with voltage U1 (boost voltage) is applied to the solenoid drive 3 in order to move the armature 4 and the nozzle needle from the state in FIG. 1 to the state in FIG. 2. The voltage pulse 31 ends when the current intensity 35 reaches a predetermined maximal value (peak current) IP. Thereafter, a somewhat lower coil current IH (also referred to as holding current) is maintained for the duration of the injection process by application of a series of relatively small voltage pulses 32 to the solenoid drive 3, so that the fuel injector 1 remains open, i.e. remains in the state shown in FIG. 2. Here, the holding current IH refers to the mean current value which is produced by switching on and switching off in accordance with the voltage pulses 32. This mean current IH leads to a corresponding mean magnetic force. Owing to the inertia, the mechanism does not react to switching on and switching off, and therefore the voltage pulses 32 do not cause any armature movement.

In the case of an unfavourable ratio between the magnetic force and the hydraulic force due to a drop in pressure, it may be the case that, owing to a current which is selected to be too high (and therefore an excessively high magnetic force), the gap 10 between the armature 4 and the pole piece 6 is closed or the drop in pressure is so great that there is no longer any volumetric flow available for the injection process. This situation may occur in a vehicle, for example, in the event of failure of the high-pressure pump (so-called low-pressure limp home). Therefore, only the preliminary delivery pressure (up to approximately 10 bar) is still available. The injector 1 is typically designed for operation at substantially higher pressures and therefore the design of the magnetic circuit is too powerful for operation at 5 to 10 bar.

Figure 4:
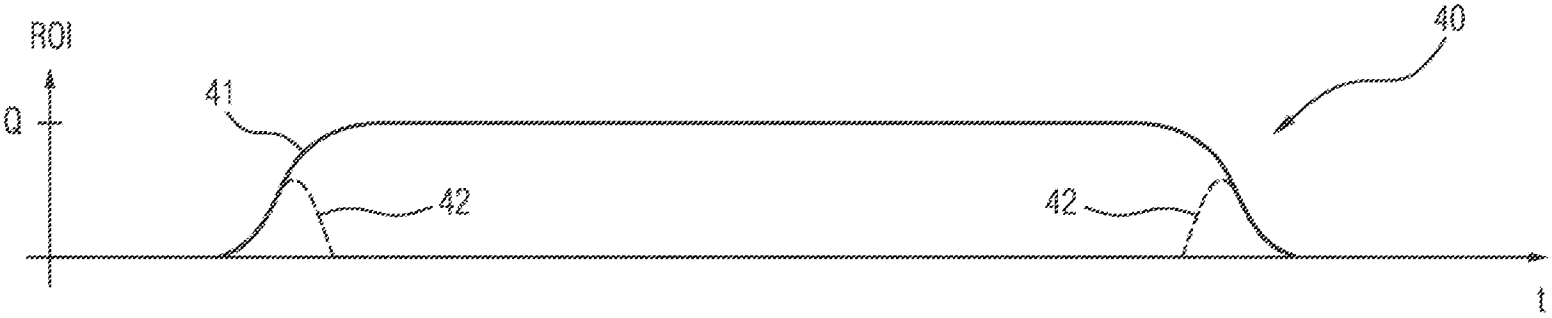
FIG. 4 shows respective temporal profiles of the injection rate of a fuel injector having a hydraulic stop in the case of conventional operation in a normal operating state and in an operating state with a disparity between the magnetic force and the hydraulic force, for example on account of a reduced fuel pressure and an excessively high magnetic force.

The diagram 40 in FIG. 4 shows the respective temporal profiles 41 and 42 of the injection rate ROI in the case of conventional operation (i.e. with the actuation shown in FIG. 3) of the fuel injector 1 in a normal operating state (at normal fuel pressure) and in an operating state with reduced fuel pressure. The temporal profile 41 corresponds to the normal state in which the injection rate or ROI increases approximately from the end of the boost phase until the maximal rate Q̇ is reached and then drops again only at the end of actuation. By contrast, the temporal profile 42 corresponds to the state with a reduced fuel pressure. Here, the injection rate also rises briefly, but drops again before the maximum rate Q̇ is reached and remains at zero until shortly before the end of actuation, since the gap 10, on account of the high magnetic force relative to the hydraulic force, is closed or is so small that the pressure drop in the gap becomes excessive. The gap 10 is briefly opened, or becomes sufficiently large, to allow a volumetric flow to pass through again only when the magnetic force has again dropped after the holding current IH is switched off (cf. FIG. 3). At the end of the closing process, the injection bores 9 are closed by the nozzle needle 5, and the width of the gap 10 is at a maximum. Therefore, in this case, considerably less fuel is injected overall and further travel is hardly possible because the required quantity of fuel cannot be delivered.

Figure 5:
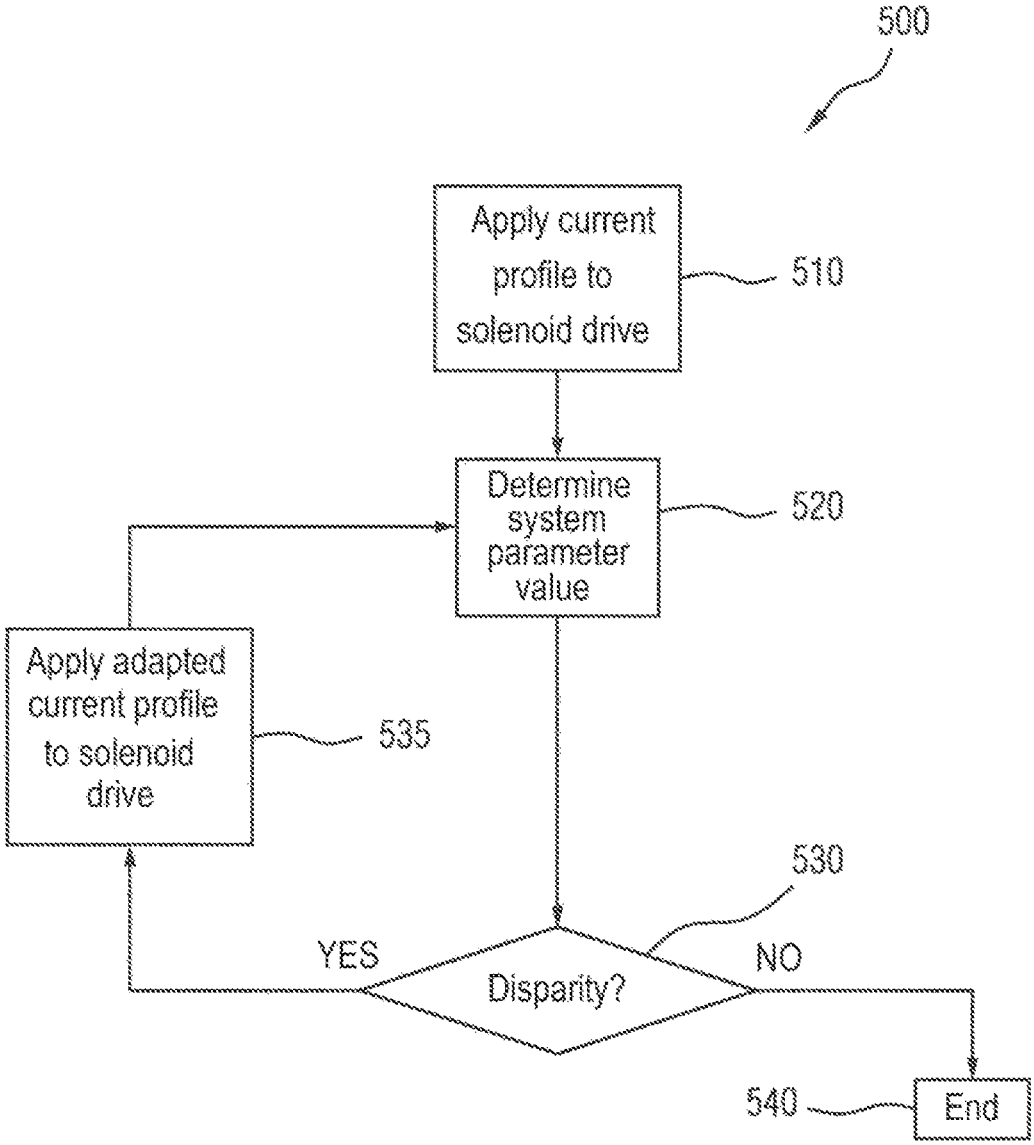
FIG. 5 shows a flowchart of a method incorporating the teachings of the present disclosure.

FIG. 5 shows a flowchart 500 of a method incorporating teachings of the present disclosure for solving the above problem by adapting a current profile, when the actually injected fuel quantity is so much smaller than the predefined fuel quantity that a disparity could exist between the magnetic force and the hydraulic force. The method begins at 510, in that a first current profile is applied to the solenoid drive of the fuel injector 1 in order to carry out a first injection process and thereby inject a predetermined injection quantity. The first current profile is chosen such that an injection of the predetermined injection quantity is to be expected under normal (or expected) circumstances, in particular in the case of a normal (or an already known, reduced) fuel pressure.

At 520, a first value of a system parameter is determined, in particular in relation to a cylinder-specific smooth running, a cylinder-specific lambda measurement, or a cylinder-specific misfire detection. This value is indicative of a relationship between actually injected fuel quantity and predefined fuel quantity, in the sense that a defective injection (in particular an actually injected fuel quantity which is much too small) can be detected.

At 530, it is determined, on the basis of the determined first value of the system parameter, whether the actually injected fuel quantity is so much smaller than the predefined fuel quantity that this could be caused by a disparity between a magnetic force exerted on the armature 4 in the direction of the pole piece 6 and an opposite hydraulic force exerted on the armature 4 by fuel.

If it is determined at 530 that such a disparity exists (YES), at 535 an adapted (second) current profile is applied to the solenoid drive of the fuel injector 1 in order to perform a second injection process. The second current profile, in comparison with the first current profile, is specified such that the magnetic force that is exerted on the armature 4 in the direction of the pole piece 6 is lower than on use of first current profile. This can be achieved in particular by predefining a smaller peak current value and/or a smaller holding current value and/or a lower voltage.

After applying the second current profile at 535, at 520 a corresponding (second) value of the system parameter is determined, and then at 530, based on the determined second value of the system parameter, it is determined whether the actually injected fuel quantity is still so much smaller than the predefined fuel quantity that this could still be caused by a disparity between the magnetic force and hydraulic force. This loop is then repeated until it is determined at 530 that there is no disparity between the magnetic force and hydraulic force. However, a lower limit for the magnetic force must be taken into account in order to avoid choking of the nozzle needle 5. In other words, a minimal current profile must be taken into account at which a correct function of the fuel injector is ensured. If it is not possible to achieve a satisfactory value of the system parameter with the minimal current profile, the method must be ended.

If it is determined at 530 that the value of the system parameter no longer indicates or could indicate a disparity between the magnetic force and hydraulic force (NO), then the method ends at 540. Once the disparity has thus been eliminated, the injected fuel quantity may if required be adjusted more accurately using closed-loop control methods known per se, such as, for example, adapting an actuation time as a function of detected opening and/or closing times.

LIST OF REFERENCE SIGNS

1 Fuel injector
2 Housing
3 Coil
4 Armature
5 Nozzle needle
6 Pole piece
7 Calibration spring
8 Valve seat
9 Injection bore
10 Gap
11 Fuel flow
30 Diagram
31 Voltage pulse
32 Voltage pulse
35 Current intensity
IP Peak current
U1 Booster voltage
IH Holding current
t Time
40 Diagram
41 Injection rate profile
42 Injection rate profile
Q Injection rate
500 Method
510-540 Method step

What is claimed is:

1. A method for operating a fuel injector having a hydraulic stop, a solenoid drive, and a pole piece, wherein the solenoid drive has a movable armature and a nozzle needle moved by the armature, the method comprising:

applying a first current profile to the solenoid drive to perform a first injection process by moving the armature toward the pole piece to the hydraulic stop and inject a predefined injection quantity through a gap between the movable armature and the pole piece into a cylinder of an internal combustion engine;

determining a first value of a system parameter indicative of a relationship between an actual injected fuel quantity and the predefined fuel quantity, wherein the system parameter measures an operational variable of the cylinder;

determining, on the basis of the determined first value of the system parameter, whether the actual injected fuel quantity is smaller than the predefined fuel quantity by a predefined amount corresponding to a disparity between a magnetic force exerted on the armature in the direction of the pole piece and the hydraulic stop caused by an opposite hydraulic force exerted on the armature by fuel; and if it was determined that the quantities differ by the predefined amount, applying a second current profile to the solenoid drive to perform a second injection process into the cylinder;

wherein the second current profile, in comparison with the first current profile, exerts a lower magnetic force on the armature in the direction of the pole piece.

2. The method as claimed in claim 1, wherein the system parameter corresponds to at least one of: a cylinder-specific smooth running, a cylinder-specific lambda measurement, or a cylinder-specific misfire detection.

3. The method as claimed in claim 1, wherein:

the first current profile has an associated first peak current value;

the second current profile has an associated second peak current value; and the second peak current value is smaller than the first peak current value.

4. The method as claimed in claim 1, wherein:

the first current profile has an associated first holding current value;

the second current profile has an associated second holding current value; and the second holding current value is smaller than the first holding current value.

5. The method as claimed in claim 1, wherein:

the first current profile is applied by a first voltage pulse;

the second current profile is applied by a second voltage pulse; and the second voltage pulse has a lower voltage than the first voltage pulse.

6. The method as claimed in claim 1, further comprising:

determining a second value of the system parameter;

determining, on the basis of the determined second value of the system parameter, whether the actually injected fuel quantity differs from the predefined fuel quantity by a predetermined quantity corresponding to a disparity between a magnetic force exerted on the armature in the direction of the pole piece and an opposite hydraulic force exerted on the armature by fuel; and if the difference exceeds the predetermined quantity, applying a third current profile to the solenoid drive of the fuel injector in order to perform a third injection process;

wherein the third current profile, in comparison with the second current profile, exerts a lower magnetic force on the armature in the direction of the pole piece.

7. The method as claimed in claim 1, wherein determining whether the actually injected fuel quantity differs from the predefined fuel quantity by a predetermined quantity comprises comparison of the determined value of the system parameter with a reference value.

8. An engine control unit for a vehicle, the control unit comprising:

a processor; and a memory storing a set of instructions, the set of instructions when loaded and executed by the processor, causing the processor to:

apply a first current profile to a solenoid drive to perform a first injection process by moving the armature toward the pole piece to the hydraulic stop and inject a predefined injection quantity through a gap between the movable armature and the pole piece into a cylinder of an internal combustion engine;

determine a first value of a system parameter indicative of a relationship between an actual injected fuel quantity and the predefined fuel quantity, wherein the system parameter measures an operation variable of the cylinder;

determine, on the basis of the determined first value of the system parameter, whether the actual injected fuel quantity is smaller than the predefined fuel quantity by a predefined amount corresponding to a disparity between a magnetic force exerted on the armature in the direction of the pole piece and the hydraulic stop caused by an opposite hydraulic force exerted on the armature by fuel; and if it was determined that the quantities differ by the predefined amount, apply a second current profile to the solenoid drive to perform a second injection process;

wherein the second current profile, in comparison with the first current profile, exerts a lower magnetic force on the armature in the direction of the pole piece.

9. A computer program comprising a set of instructions stored on a non-transitory computer readable medium, the set of instructions when loaded and executed by a processor, causing the processor to:

apply a first current profile to a solenoid drive to perform a first injection process by moving the armature toward the pole piece to the hydraulic stop and inject a predefined injection quantity through a gap between the movable armature and the pole piece into a cylinder of an internal combustion engine;

determine a first value of a system parameter indicative of a relationship between an actual injected fuel quantity and the predefined fuel quantity, wherein the system parameter measures an operational variable of the cylinder;

determine, on the basis of the determined first value of the system parameter, whether the actual injected fuel quantity is smaller than the predefined fuel quantity by a predefined amount corresponding to a disparity between a magnetic force exerted on the armature in the direction of the pole piece and the hydraulic stop caused by an opposite hydraulic force exerted on the armature by fuel; and if it was determined that the quantities differ by the predefined amount, apply a second current profile to the solenoid drive to perform a second injection process;

wherein the second current profile, in comparison with the first current profile, exerts a lower magnetic force on the armature in the direction of the pole piece.

* * * * *